US005699750A

United States Patent [19]

Schneider

[11] Patent Number: 5,699,750

[45] Date of Patent: Dec. 23, 1997

[54] SELF-BAILING WATERSPRITE WITH POSITIVE BUOYANCY

[75] Inventor: Charles R. Schneider, Oshkosh, Wis.

[73] Assignee: Brunswick Corporation, Lake Forest, Ill.

[21] Appl. No.: 707,011

[22] Filed: Sep. 3, 1996

[51] Int. Cl.[6] ..... B63B 5/24

[52] U.S. Cl. ..... 114/357; 114/182; 114/183 R

[58] Field of Search ..... 114/357, 69, 270, 114/183 R, 182, 197, 355

[56] References Cited

U.S. PATENT DOCUMENTS

| | | | |
|---|---|---|---|
| 1,572,074 | 2/1926 | Nelson | 114/182 |
| 3,063,069 | 11/1962 | Brummer | 114/355 |
| 3,435,470 | 4/1969 | Krenzler | 114/357 |
| 3,790,977 | 2/1974 | Bombardier et al. | 114/357 |
| 3,982,497 | 9/1976 | Caron | 114/357 |
| 5,036,789 | 8/1991 | Kelly et al. | 114/357 |

FOREIGN PATENT DOCUMENTS

| | | | |
|---|---|---|---|
| 147491 | 6/1990 | Japan | 114/182 |

*Primary Examiner*—Sherman Basinger

*Attorney, Agent, or Firm*—Andrus, Sceales, Starke & Sawall

[57] ABSTRACT

A watersprite has a modified inner hull liner and an automatic liquid bailing system to reduce chemical deterioration of the inner hull liner and eventually other components of the watersprite. The inner hull liner provides a dam for water and/or spilled fuel so that the liquid accumulates at least temporarily at a location above the waterline for the watersprite. The accumulated liquid is immediately drained through a self-bailing pipe to the outside environment. The inlet for the self draining pipe is located in the vicinity of the bottom of the dam, which defines a low spot for the inner hull liner. In addition, the bilge volume between the inner hull liner and the outer hull assembly is completely filled with closed-cell flotation foam. The closed-cell flotation foam in the bilge volume helps to prevent water and/or spilled fuel from chemically attacking the hull and/or hull stiffeners in case the inner hull liner develops a leak. The flotation foam also provides additional structural integrity between the inner hull liner and the outer hull assembly. In addition, the flotation foam provides a watersprite with positive buoyancy to eliminate the threat of partial flooding and/or sinking in case the outer hull develops a crack, or in case the watersprite fills with splash water or rainwater.

12 Claims, 3 Drawing Sheets

FIG. 1
PRIOR ART
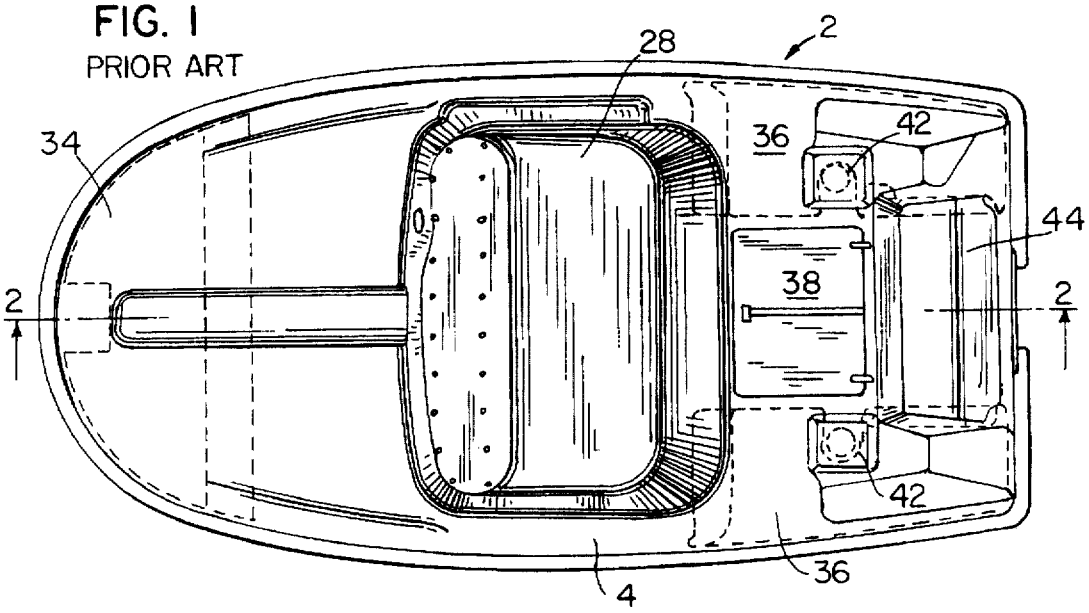
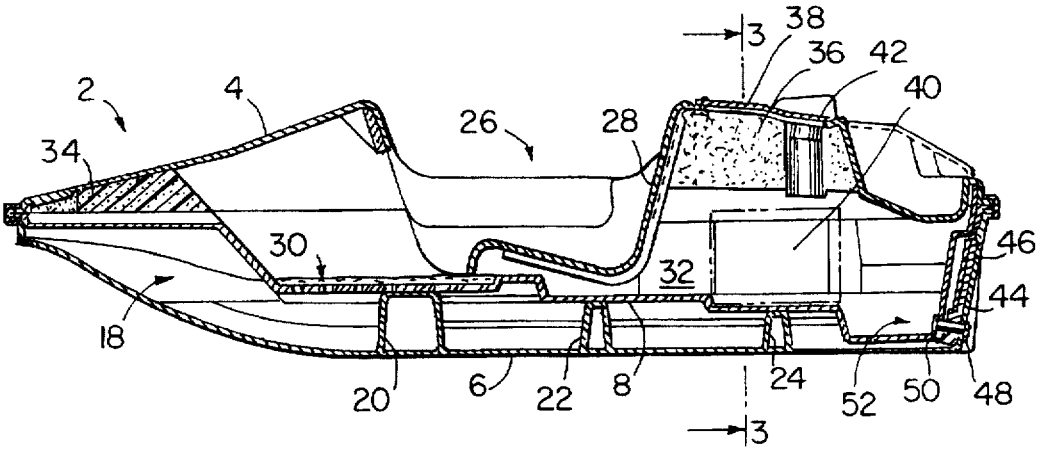
FIG. 2
PRIOR ART
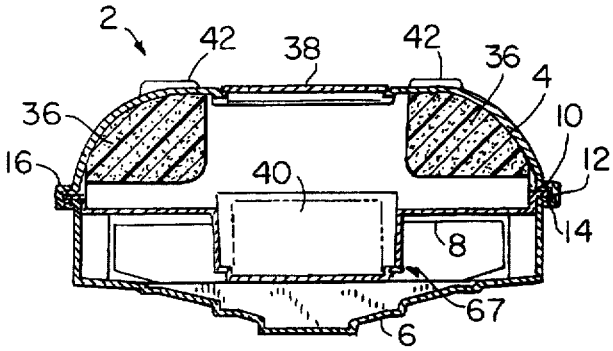
FIG. 3
PRIOR ART

SELF-BAILING WATERSPRITE WITH POSITIVE BUOYANCY

FIELD OF THE INVENTION

The invention relates to small passenger boats often called watersprites. In particular, the invention relates to a self-bailing watersprite having positive buoyancy. These features lengthen the useful life and safety of watersprites.

BACKGROUND OF THE INVENTION

Watersprites are commonly used at theme or amusement parks, or at rental facilities on small bodies of water. Watersprites usually seat two people, and are powered by a small outboard motor, (e.g., a ten horsepower outboard motor). The outboard motor is attached to the transom of the watersprite rearward of the passenger compartment. The structure of typical watersprites includes three major components: an outer hull assembly, an inner hull liner, and an upper deck assembly. The peripheral edges of the outer hull assembly, the inner liner assembly, and the upper deck assembly are adhered together along a split line. A rub rail is secured over the split line to secure the assemblies. Water from splashing or from rain passes through the floor of a passenger compartment in the upper deck assembly onto the inner hull liner. Water on the inner hull liner is typically drained through the transom of the watersprite by pulling the watersprite from the water. Hull stiffeners are placed in the bilge between the outer hull assembly and the inner hull liner to support the outer hull assembly and prevent the outer hull assembly from flexing when the watersprite is moving.

Due to intense usage, watersprites can deteriorate prematurely if not properly maintained. One particular problem involves spilled fuel (usually mixed with water), which can pool in the watersprite in a low spot in the hull on top of the inner hull liner. The inner hull liner is usually made of a thermal set material or thermal plastic material such as ABS. Pooled fuel and water can prematurely deteriorate the hull structural plastic material. The inner hull liner is more susceptible to cracking after it has been exposed to pool fuel and water. Typical maintenance procedure requires that the watersprite be pull from the water and drained frequently to lessen this type of chemical deterioration.

After the inner hull liner deteriorates and cracks, fuel and water can leak into the bilge (i.e. the space between the outer hull assembly and the inner hull liner). Hull stiffeners in the bilge are also made of ABS plastic, and are also susceptible to deterioration when exposed to fuel/water mixtures. Once the hull stiffeners start to deteriorate, the structural stability of the outer hull assembly can deteriorate quickly due to the intense use and repeated flexing of the outer hull.

Watersprites are typically designed to plane at a relatively low speed (e.g., 14 mph). Once the plastic hull stiffeners deteriorate, the outer hull assembly begins to flex, and the outer hull develops cracks as a result of the bow wave when the watersprite is on plane. With cracks in the outer hull, the watersprite takes on water and may even begin to sink. Watersprites typically contain floatation foam above the split line to prevent the watersprite from sinking completely.

SUMMARY OF THE INVENTION

The invention is a self-bailing watersprite having flotation foam completely filling the bilge volume. The invention therefore reduces chemical deterioration of watersprites due to accumulated water and/or fuel within the bilge volume. In addition, a watersprite in accordance with the invention is positively buoyant so that the watersprite will not flood in the event that the outer hull develops a crack.

A watersprite in accordance with the invention has a plastic outer hull assembly, a plastic inner hull liner, and an upper deck assembly which are connected together at their respective peripheral edges along a split line. Water from splashing or from rain passes through a passenger compartment in the upper deck assembly onto the inner hull liner. The inner hull liner is designed so that the low spot of the inner hull liner is positioned above the waterline of the watercraft. The watersprite also has a self-bailing pipe (i.e. a connecting pipe) that has an inlet opening into the space above the inner hull liner in the vicinity of the low spot. The self-bailing pipe has an outlet outside of the watersprite. The self-bailing pipe preferably has an outlet opening rearward of a transom of the watersprite. The inlet of the pipe is positioned at least as high as the outlet of the pipe so that the self-bailing pipe drains liquid, such as water and/or spilled fuel, that has accumulated temporarily at the low spot on the inner hull liner into the body of water. Immediate draining of water and/or spilled fuel greatly reduces the possibility of chemical deterioration of the hull and structural members.

The inner hull liner is also designed to provide a location for placing the fuel tank that is higher and also remote from the vicinity of the low spot of the inner hull liner. With this design, it is unlikely that the fuel tank will ever be located in pooled water and/or pooled water and fuel.

While it is preferred that the invention be carded out having an inner hull liner with a modified design as described above, the invention can also be carried out by retrofitting a prior art watersprite by building a suitable dam and/or fuel tank platform to effectively carry out the functions of the above-described modified inner hull liner.

In another aspect, the invention involves completely filling the bilge volume between the outer hull assembly and the inner hull liner with closed-cell flotation foam. Preferably, closed-cell flotation foam is also used to fill hollow stiffeners located in the bilge volume that support the outer hull assembly in relation to the inner hull liner. Filling the bilge volume with closed-cell flotation foam reduces the likelihood that accumulated water and/or gasoline will penetrate towards the hull stiffeners in case the inner hull lining develops a crack or leak. In addition, completely filling the bilge volume with foam provides structural integrity to the outer hull assembly, thereby further reducing the likelihood that the outer hull assembly will flex as the watersprite travels through the water or plane. In addition, completely filling the bilge volume with flotation foam provides a watersprite having positive buoyancy, thus eliminating the chance of partially flooding the passenger compartment in the watersprite in the event that the outer hull cracks.

Other features and advantages of the invention may be apparent upon inspecting the drawings and the following description thereof.

BRIEF DESCRIPTION OF THE DRAWINGS

Prior Art

FIG. 1 is a top view of a watersprite in accordance with the prior art;

FIG. 2 is a sectional view of the prior art watersprite taken along liner 2—2 of FIG. 1;

FIG. 3 is a cross-sectional view of the prior art watersprite taken along lines 3—3 of FIG. 2;

Invention

Figure 4:
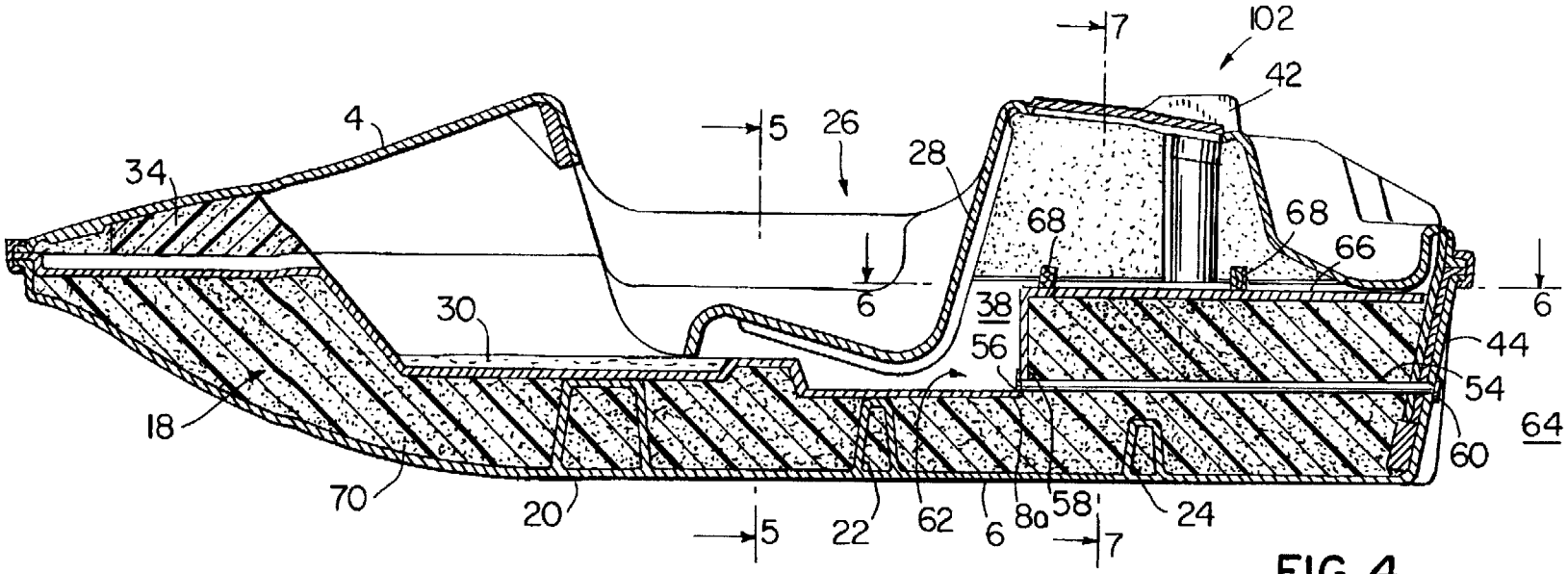
Figure 5:
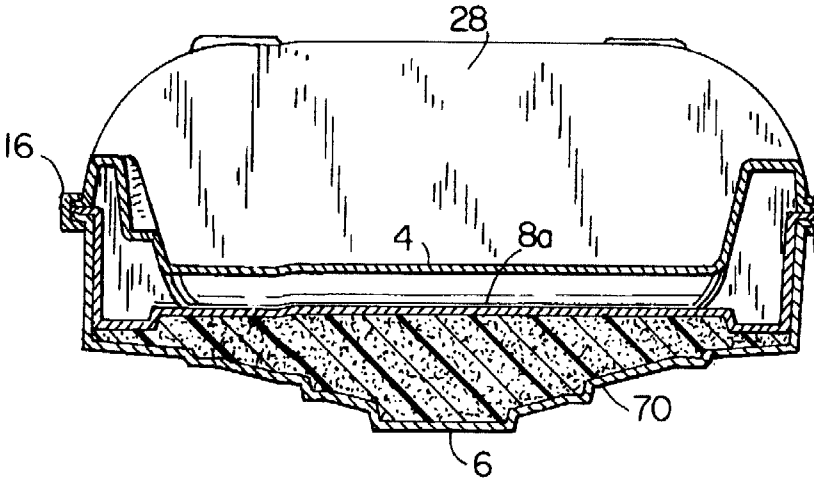
Figure 6:
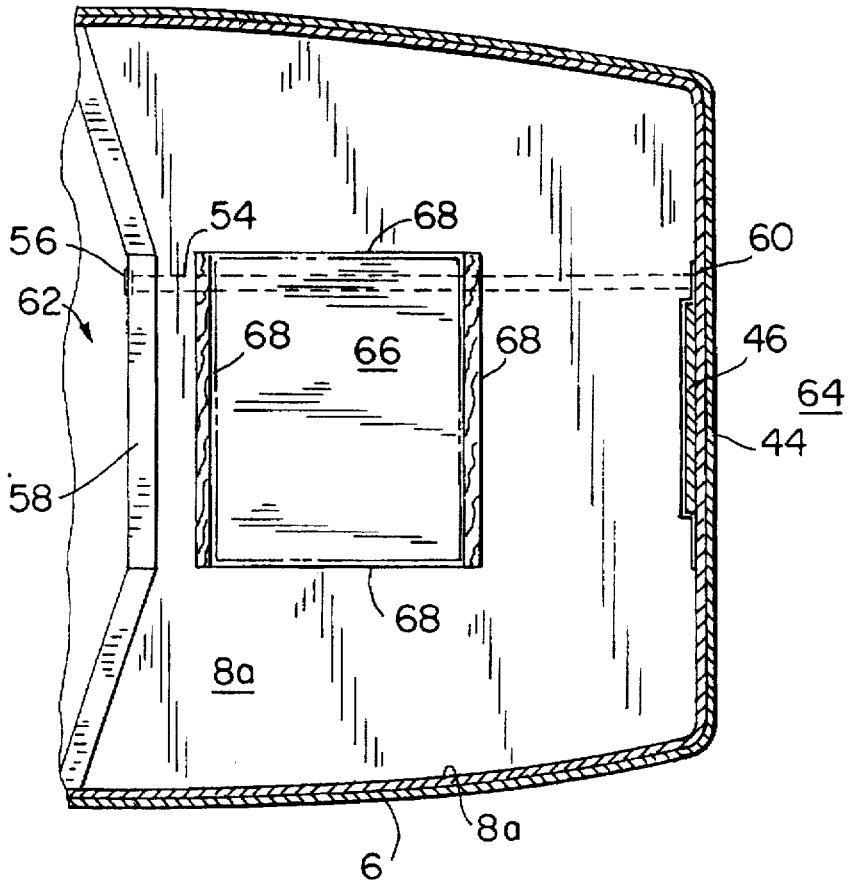

FIG. 4 is a sectional view of a watersprite in accordance with the invention;

FIG. 5 is a cross-sectional view taken along lines 5—5 of FIG. 4;

FIG. 6 is a view taken along lines 6—6 of FIG. 4; and

Figure 7:
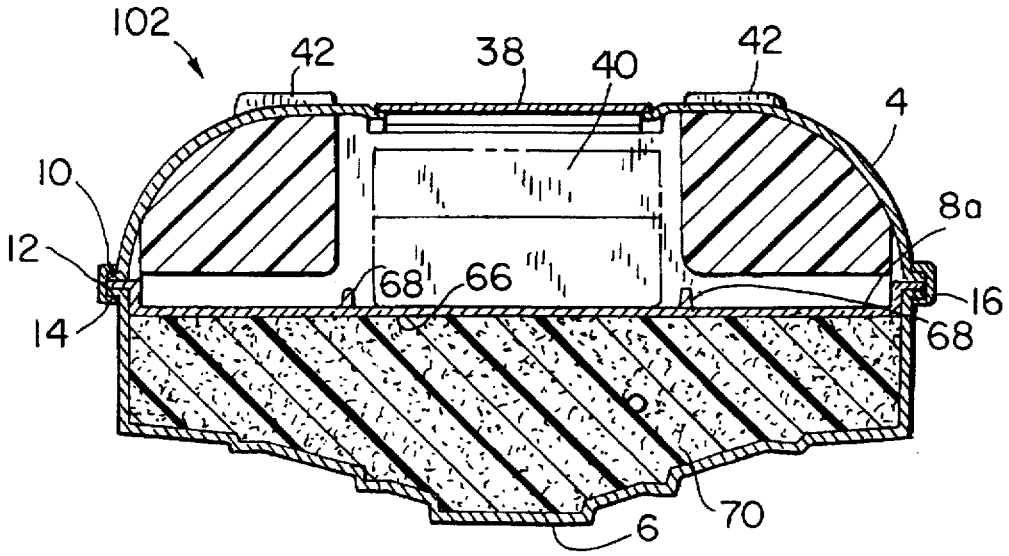

FIG. 7 is a cross-sectional view taken along lines 7—7 of FIG. 4.

DETAILED DESCRIPTION OF THE DRAWINGS

Prior Art

FIGS. 1–3 illustrate a watersprite 2 as known in the art. The watersprite 2 has an upper deck assembly 4, an outer hull assembly 6 and an inner hull lining 8. The peripheral edge 10 of the upper deck assembly 4, the peripheral edge 12 of the inner hull liner 8 and the peripheral edge 14 of the outer hull assembly 6 are adhered together along a split line for the watersprite 2, FIG. 3. A rub rail 16 extends around the split line of the boat coveting peripheral edges 10, 12 and 14.

A bilge volume 18 is defined between the outer hull assembly and the inner hull liner 8. Three hull stiffeners 20, 22 and 24 are positioned transversely across the bilge volume 18. The hull stiffeners 20, 22 and 24 can be integral with the outer hull assembly 6, but the hull stiffeners 20, 22 and 24 can be part of a separate stiffener assembly that is installed in the bilge volume 18. The hull stiffeners 20, 22 and 24 span vertically across the bilge volume 18 to support the outer hull assembly 6 in a fixed position relative to the inner hull liner 8. If the stiffener assembly is separate from the outer hull assembly 6, the outer hull assembly 6 is typically made of a PVC and ABS laminate sheet, and the hull stiffeners 20, 22 and 24, and the inner hull liner 8 are typically made of 3/16 inch ABS plastic.

The upper deck assembly 4 includes a passenger compartment 26 having a seat 28 molded therein. A plywood support floor 30 is typically affixed to the inner hull liner 8 forward of the seat 28 to provide a secure floor structure for riders to place their feet. The volume between the inner hull liner 8 and the upper deck assembly 4 defines a deck space 32. It is known in the art to place flotation foam 34, 36 in the deck space between the upper deck assembly 4 and the inner hull liner 8. Flotation foam 34 is placed forward of the passenger compartment 26, and flotation foam 36 is placed rearward of the passenger compartment 26. Heretofore, flotation foam has been provided in watersprites 2 to fill volumes located above the split line, which prevents complete sinking in case the outer hull 6 cracks or in case the outer hull fills with splashed water or rainwater.

Rearward of the seat 28, the upper deck assembly 4 provides a fuel tank hood 38. The fuel tank hood 38 can be opened to allow access to the deck space 32 rearwarde of the seat 28. In the prior art, it is known to place a gasoline fuel tank 40 within the deck space 32 underneath the fuel tank hood 38. Vents 42 are provided through the upper deck assembly into the deck space 32.

An outboard engine (not shown) is mounted in the conventional manner to a transom backplate 44 located rearward of the fuel tank 40. A ¾ inch marine plywood transom board 46 is typically used to strengthen the motor support area on the transom 44.

A conventional marine drain 48 having a plug is provided through the lower part of the transom 44 on the watersprite 2. The marine drain 48 has an inlet 50 that is located generally at a low spot within the deck space 32 above the inner hull liner 8 generally depicted by arrow 52. Water splashing into the deck space 32 through the floor area of the passenger compartment 26, or through leaks in the watersprite 2, as well as spilled fuel from the gasoline tank 40 can accumulate in the region indicated by arrow 52. In the region of arrow 52, there are holes in the inner liner 8 allowing water/fuel to egress into the bilge volume 18. It should be noted that the fuel tank 40 is generally located in the path of water flow from the passenger compartment 26 to the marine drain 48 in the transom 44. In case of rain, or heavy use, water mixed with spilled gasoline in these prior art watersprites 2 can actually rise to such a height within the deck space 32 that the gasoline tank 40 floats. When this happens, the tank 40 can turtle or capsize because the fuel cap and connecting lines are at the top of the fuel tank 40. If the tank 40 capsizes, fuel will leak through the fuel cap vent hole.

Because the inlet 50 to the marine valve 48 is located below the waterline for the watersprite 2, the watersprite 2 must be removed from the water in order to drain accumulated water and/or fuel within the deck space. Pooled water and/or fuel in the region of arrow 52 and within the bilge volume 18 can chemically deteriorate the inner hull lining 8, the hull stiffeners 20, 22 and 24, as well as the outer hull 6 if the water/gasoline mixture is not drained in a timely manner.

Present Invention

FIGS. 4–7 illustrate a watersprite 102 that has been modified in accordance with the invention. Similar reference numerals have been used in FIGS. 4–7 in describing the invention as were used in FIGS. 1–3 describing the prior art watersprite where appropriate to facilitate proper understanding of the invention.

The watersprite 102 in accordance with the invention has a modified inner hull liner 8*a* and a self-bailing pipe 54. The self-bailing pipe 54 is preferably made out of polyvinyl chloride (PVC) or chemically stable material. The self-bailing pipe 54 has an inlet 56 opening into the deck space 38 above a low point in the inner liner 8*a*. The modified inner hull liner 8*a* has dam 58 positioned within the deck space 38 at a location above the waterline for the watersprite 102. The dam 58 prevents the flow of liquid within the deck space 38 to a location that is lower than the waterline for the watersprite 102. In particular, the forward portion of the inner hull liner 8*a* slopes generally downward as the liner 8*a* progresses rearward. The longitudinal position of the dam 58 (positioned from right to left in FIG. 4) is selected so that the height of the bottom of the dam 58 is above the waterline for the watersprite 102. The inlet 56 to the self-bailing pipe 54 is located at the bottom of the dam 58. The self-bailing pipe 54 is preferably horizontal or tilted slightly downward as the pipe 54 extends rearward. The self-bailing pipe 54 extends rearward through the transom 44 so that an outlet 60 of the pipe 54 outputs liquid (e.g., water and/or spilled fuel) to the outside environment 64.

With the configuration shown in FIGS. 4–7, excess water from rain or splashing as well as spilled fuel accumulates temporarily in the region depicted by arrow 62 and immediately drains through self-bailing pipe 54 to the outside environment 64. Immediate bailing of water and/or spilled fuel greatly reduces chemical deterioration that can occur to the inner hull liner 8.

The location of the gasoline tank 40 in watersprite 102 has been raised in accordance with the invention to make it more difficult for spilled or leaked gasoline to pool within the watersprite 102 underneath the waterline. In particular, the rear portion 66 of the inner hull liner 8*a*, FIG. 7, has been modified to span essentially horizontally between the sides of the watersprite 102, rather than dipping in the middle to provide a depressed compartment for the fuel tank 40 as in the prior art, FIG. 3. Fuel tank support flanges 68 extend upwardly from the rear horizontal portion 66 of the modified inner liner 8*a*. The fuel tank 40 is secured in position by flanges 68 on top of surface 66. The surface 66 on the inner hull liner 8*a* is located above the waterline, and also above the inlet 56 for the self-bailing drain pipe 54. The fuel tank 40 can be accessed through hood 38, but the fuel tank is no longer located in the normal flow path of water through the watersprite 102. The fuel tank 40 is also located above the swamped condition water line such that the fuel tank will not capsize and leak fuel through the fuel cap air vent hole.

While the invention described thus far involves the use of a modified inner hull liner 8*a*, the invention can be carried out by retrofitting a prior art watersprite as shown in FIGS. 1–3 without modifying the inner hull liner 8. In such a retrofit, the dam 58 can be made of plywood or any other suitable material. The dam 58 should span upward from the inner hull liner 8 and span horizontally across deck space 38 in a manner suitable to prevent flow of liquid rearward of the dam 58. Silicone can be used to seal the dam 58 against the inner surface of the inner hull liner 8. In addition, a horizontal platform corresponding to rear portion 66 of the inner hull liner 8*a* can be made of plywood or any other suitable material.

In accordance with another aspect of the invention, marine flotation foam 70 completely fills the bilge volume 18 between the outer hull assembly 6 and the inner hull liner 8. The marine flotation foam is preferably a closed-cell foam which can be purchased in accordance with Coast Guard regulations. It is preferred that the flotation foam 70 also fill hollow volumes within stiffeners 20, 22 and 24.

It is preferred that the closed-cell foam 70 completely fill the bilge volume 18 so that the foam 70 displaces or fills space within the bilge 18 that could be filled with water and/or gasoline in the event that the outer hull 6 or the inner liner 8 were to leak. In the event that the hull 6 cracks or that the inner hull liner 8 deteriorates, completely filling the bilge 18 with closed-cell foam lessens the ability of water and/or spilled gasoline to penetrate into the bilge 18 and exacerbate hull and superstructure deterioration. Another advantage of completely filling the bilge volume 18 with flotation foam 70 is that it provides additional support to the outer hull assembly 6 so that the outer hull assembly 6 remains rigid and does not flex as the watersprite 102 travels across water.

Completely filling the bilge volume 18 with flotation foam 70 also makes the watersprite 102 positively buoyant (i.e., the watersprite 102 will remain completely buoyant and avoid flooding of the passenger compartment 26 even if the outer hull 6 develops a crack). Raising the fuel tank 40 in accordance with the invention facilitates the positive buoyancy feature because it increases the size of the bilge volume 18 thereby allowing for a greater amount of flotation foam 70 within the bilge volume 18. The outer hull assembly 6 and the upper deck assembly 4 are made out of any suitable type of plastic, such as polyvinyl chloride (PVC). The inner hull liner 8 is typically made out of any suitable type of plastic, such as ABS.

It is recognized that various alternatives and modifications of the invention are possible in accordance with the true spirit of the invention, and such modifications or alternatives should be considered to be within the scope of the claims.

I claim:

1. A watersprite comprising:

a plastic outer hull assembly having peripheral edge;

a plastic inner hull liner having a peripheral edge that is attached to the peripheral edge of the outer hull, the inner hull liner being placed above the outer hull assembly to define a bilge volume therebetween;

at least one stiffener located in the bilge volume between the outer hull assembly and the inner hull liner to support the outer hull assembly in a fixed position relative to the inner hull liner;

closed-cell foam completely filling the bilge volume;

an upper deck assembly having a peripheral edge that is attached to the peripheral edge of the outer hull and to the peripheral edge of the inner hull liner, the upper deck assembly being located above the inner hull liner to define a deck space therebetween; and a self-bailing pipe having an inlet opening into the deck space between the upper deck assembly and the inner hull liner and an outlet opening outside of the watersprite, the inlet of the pipe being positioned above the waterline of the watersprite and at least as high as the outlet of the pipe so that the self-bailing pipe drains liquid that has accumulated within the deck space to the outside environment.

2. The watersprite of claim 1 wherein the outlet of the self-bailing pipe is positioned above the waterline of the watersprite.

3. The watersprite of claim 1 further comprising a dam within the deck space that prevents the flow of liquid in the deck space to a position that is lower than the position of the inlet of the self-bailing pipe within the deck space.

4. The watersprite of claim 3 wherein the watersprite has a gas tank that is located higher than the dam and at a position substantially higher than the inlet to the self-bailing pipe.

5. The watersprite of claim 1 wherein the inner hull liner contains a low spot that is located above the waterline of the watersprite, and the inlet of the self-bailing pipe is positioned in the vicinity of the low spot of the inner hull liner.

6. The watersprite of claim 5 wherein the inner hull liner has a forward portion that tilts generally downward as the inner hull liner extends rearward and a dam portion that extends upward towards the rear of the forward portion of the inner hull liner to prevent the flow of liquid on the inner hull liner to a position that is lower than the waterline of the watersprite.

7. The watersprite of claim 5 wherein the watersprite has a gas tank and the inner hull liner is modified to provide a gas tank platform at a position substantially higher than the inlet of the self-bailing pipe.

8. A watersprite comprising:

a plastic outer hull assembly having a peripheral edge;

a plastic inner hull liner having a peripheral edge that is attached to the peripheral edge of the outer hull, the inner hull liner being placed above the outer hull assembly to define a bilge volume therebetween;

an upper deck assembly having a peripheral edge that is attached to the peripheral edge of the outer hull and to the peripheral edge of the inner hull liner, the upper deck assembly being located above the inner hull liner to define a deck space therebetween; and a self-bailing pipe having an inlet opening into the deck space between the upper deck assembly and the inner hull liner and an outlet opening outside of the watersprite, the inlet of the pipe being positioned above the waterline of the watersprite and at least as high as the outlet of the pipe so that the self-bailing pipe drains liquid that has accumulated within the deck space to the outside environment.

9. A watersprite as recited in claim 8 wherein the inner hull liner contains a low spot at which liquid can accumulate, and the inlet for the self-bailing pipe is located in the vicinity of the low spot of the inner hull liner.

10. A watersprite as recited in claim 8 further comprising a dam within the deck space that prevents the flow of accumulated fluid in the deck space to a position that is lower than the position of the inlet to the self-bailing pipe.

11. A watersprite as recited in claim 8 wherein the outlet of the self-bailing pipe is positioned above the waterline of the watersprite.

12. A watersprite as recited in claim 8 further comprising: at least one stiffener located in the bilge volume between the outer hull assembly and the inner hull liner to support the outer hull assembly in a fixed position relative to the inner hull liner; and closed cell-foam completely filling the bilge volume.

* * * * *